US005419495A

United States Patent [19]

Berfield

[11] Patent Number: 5,419,495

[45] Date of Patent: May 30, 1995

[54] AUXILIARY CHEMICAL INTAKE SYSTEM

[75] Inventor: Robert C. Berfield, Jersey Shore, Pa.

[73] Assignee: Shop Vac Corporation, Williamsport, Pa.

[21] Appl. No.: 201,578

[22] Filed: Feb. 25, 1994

[51] Int. Cl.[6] ..... B05B 7/30

[52] U.S. Cl. ..... 239/305; 239/310; 239/311; 239/154; 137/888

[58] Field of Search ..... 137/888; 239/310, 311, 239/318, 305, 307, 397, 148, 152, 154

[56] References Cited

U.S. PATENT DOCUMENTS

| | | | |
|---|---|---|---|
| 2,376,565 | 5/1945 | Williams | 299/84 |
| 2,381,589 | 8/1945 | Hayes | 239/318 |
| 2,640,724 | 6/1953 | Sanders et al. | 239/311 |
| 2,861,838 | 11/1958 | Wyatt et al. | 239/310 |
| 2,943,797 | 7/1960 | Neilson | 239/305 |
| 3,112,884 | 12/1963 | Gilmour | 239/318 |
| 3,207,444 | 9/1965 | Kelley et al. | 239/318 |
| 3,333,601 | 8/1967 | Lofgreen | 239/318 |
| 3,454,042 | 7/1969 | Phillips | 137/565 |
| 3,675,851 | 7/1972 | Merfeld et al. | 239/318 |
| 3,810,787 | 5/1974 | Yoeli et al. | 239/310 |
| 3,853,784 | 12/1974 | Rogers | 252/359 |
| 3,863,843 | 2/1975 | Hechler, IV | 239/318 |
| 4,033,509 | 7/1977 | Sheets | 239/226 |
| 4,322,036 | 3/1982 | Bly | 239/311 |
| 4,366,081 | 12/1982 | Hull | 252/359 |
| 4,383,935 | 5/1983 | Hull | 252/359 |
| 4,474,680 | 10/1984 | Kroll | 252/307 |
| 4,569,483 | 2/1986 | Oberdorfer | 239/307 |
| 4,736,891 | 4/1988 | Chow et al. | 239/318 |
| 4,829,624 | 5/1989 | Lackner et al. | 15/320 |
| 4,830,790 | 5/1989 | Stevenson | 261/18.1 |
| 4,848,659 | 7/1989 | Tadych | 239/127 |
| 4,901,923 | 2/1990 | McRoskey et al. | 239/123 |
| 5,007,588 | 4/1991 | Chow et al. | 239/318 |
| 5,040,950 | 8/1991 | Dalquist, III et al. | 417/234 |
| 5,152,461 | 10/1992 | Proctor | 239/304 |
| 5,230,368 | 7/1993 | Berfield | 137/889 |
| 5,259,557 | 11/1993 | Spriggs et al. | 239/318 |
| 5,310,113 | 5/1994 | Cowgur | 239/307 |

OTHER PUBLICATIONS

European Search Report, (93 30 2951) Apr. 19, 1994.

*Primary Examiner*—Andres Kashnikow
*Assistant Examiner*—Christopher G. Trainor
*Attorney, Agent, or Firm*—Marshall, O'Toole, Gerstein, Murray & Borun

[57] ABSTRACT

A chemical intake system for a pressure washer having a spray nozzle and an internal tank comprises a connector in fluid communication with the spray nozzle. The connector can be selectively placed in fluid communication with either the internal tank to draw chemical therefrom or with an external container to draw chemical therefrom.

19 Claims, 3 Drawing Sheets

AUXILIARY CHEMICAL INTAKE SYSTEM

TECHNICAL FIELD

The present invention relates generally to the control of fluid flow in a pressure washer, and more particularly to a chemical intake system in which chemical can be drawn either from an internal tank of the pressure washer or from an external container.

BACKGROUND ART

In pressure spray washers and the like it is necessary to introduce one or more fluids into the flow of another fluid. For example, a liquid soap or other cleaning agent is mixed with air and then introduced into a water flow to create a foaming mixture. Generally, the soap or other cleaning agent is drawn from a small tank which is attached or internal to the pressure washer. Because the tank is small, a cleaning operation may need to be frequently interrupted to refill the tank.

Berfield, U.S. Pat. No. 5,230,368, discloses a chemical intake system for a pressure washer which controls the amount of soap delivered into a water stream. The soap is first added to a tank which fits over the spray nozzle and which is retained against the pressure washer. A first tube interconnects the venturi with the soap in the tank. A second tube is connected between the venturi and one of a plurality of apertures in communication with an air space above the soap in the tank. Each aperture has a different diameter which permits a different amount of air flow through the second tube so that the amount of soap flowing through the suction tube into the water stream can be controlled.

Rogers, U.S. Pat. No. 3,853,784, discloses a foam forming apparatus wherein chemical is drawn from an external container, such as a bucket, and combined with water flow in a venturi. Compressed air is added to an outlet chamber and mixed with the water and chemical to generate foam through a spray nozzle.

Neither of the above systems is entirely satisfactory. While the washer disclosed in the Berfield '368 patent allows the user to control the amount of chemical introduced into the water stream, the tank attached to the pressure washer unit has a relatively small capacity that may need to be frequently refilled during long washing applications. Further, the tank must be emptied and refilled whenever it is desired to change the cleaning agent. The apparatus disclosed in the Rogers '784 patent can only be operated with a separate external chemical container, which detracts from the convenience of a self-contained unit. Thus, there remains a need for a chemical intake system for a pressure washer which allows the user to easily refill and change cleaning agents which are combined with the water flowing out the spray nozzle.

SUMMARY OF THE INVENTION

A chemical intake system for a pressure washer having a spray nozzle and an internal tank comprises a connector in fluid communication with the spray nozzle, a first hose for selectively placing the connector in fluid communication with the internal tank and a second hose, which is detachable from and external of the pressure washer, for selectively placing the connector in fluid communication with an external chemical container.

According to one aspect of the present invention, the first hose has a first end connected to the connector and a second end. The second hose has a first end coupled to a further connector, such as a male-male hose adapter, and a second end in fluid communication with the external container. A filtering element may be coupled to the second end of the second hose inserted in the external container. The second end of the first hose is connectable to either the internal tank to draw chemical therefrom or the further connector to draw chemical from the external container. The connector is also in fluid communication with the water source. The amount of chemical introduced into the water stream can be controlled by placing the connector in fluid communication with one of a plurality of apertures with varying diameters that are in fluid communication with an air space above the chemical in the internal tank.

According to another aspect of the present invention, a chemical intake system for a pressure washer having a spray nozzle and an internal tank comprises a connector in fluid communication with the spray nozzle and means for selectively placing the connector in fluid communication with one of the internal tank, an external chemical container, or a second tank attachable to the bottom of the pressure washer.

DESCRIPTION OF THE PREFERRED EMBODIMENT

Figure 1:
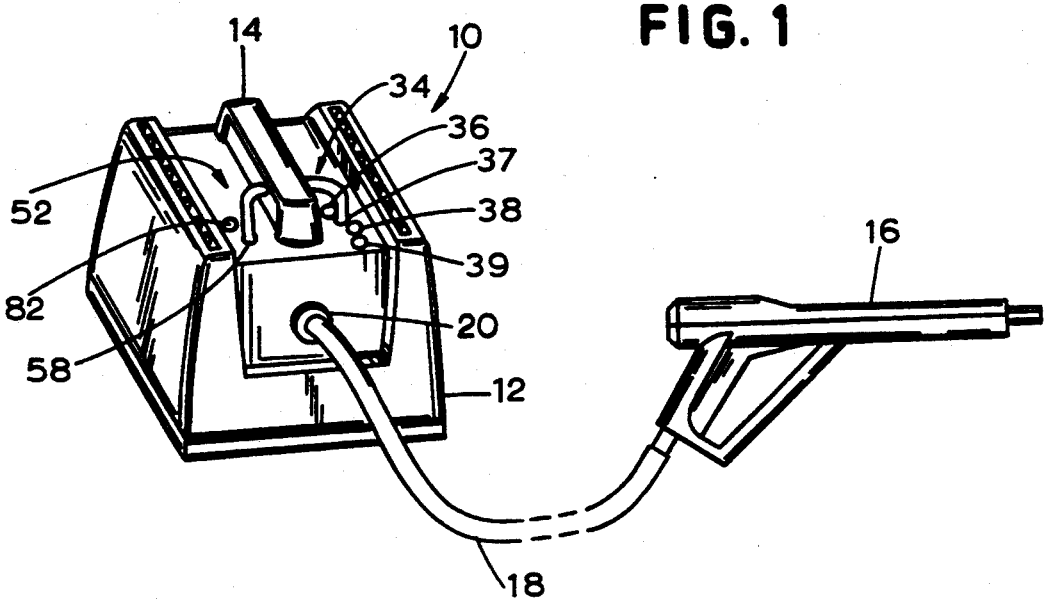
FIG. 1 is a perspective view of a pressure washer with a spray nozzle incorporating the chemical intake system of the present invention wherein a chemical is being drawn from the internal tank.
Figure 2:
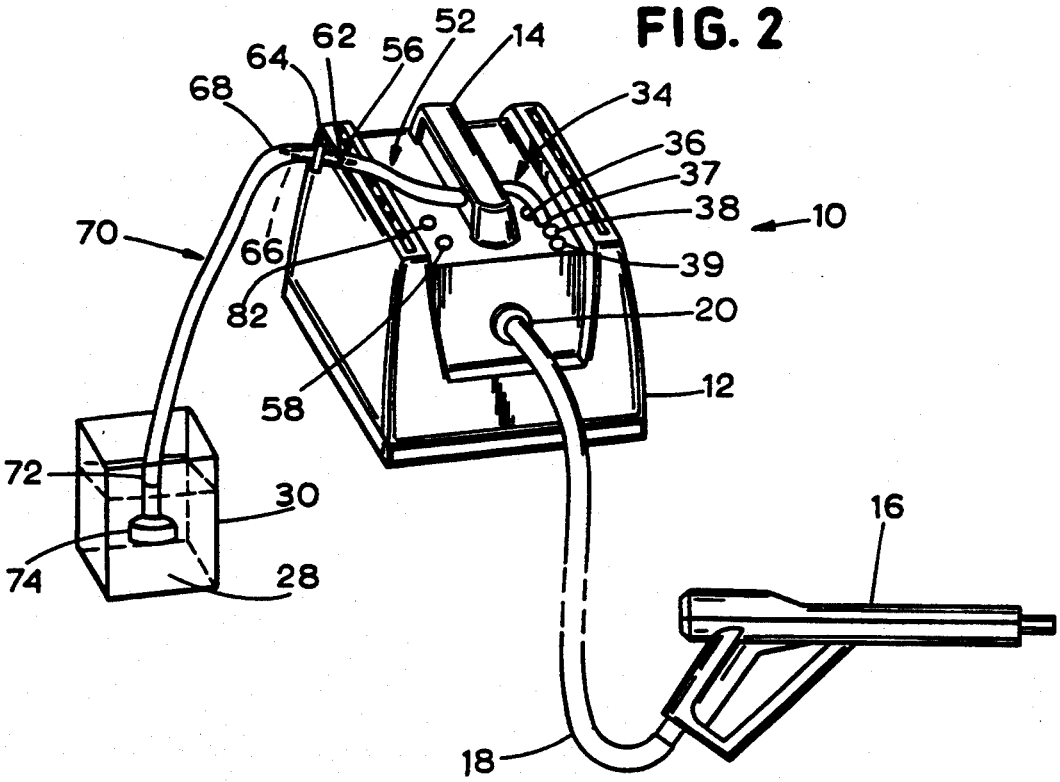
FIG. 2 is a perspective view of the pressure washer of FIG. 1 wherein a chemical is being drawn from a container external of the pressure washer.

Referring to FIGS. 1 and 2, a pressure washer 10 includes a tank housing 12 having a handle 14. A spray nozzle 16 is attached by a hose 18 to the tank housing 12 at a hose fitting 20.

Figure 3:
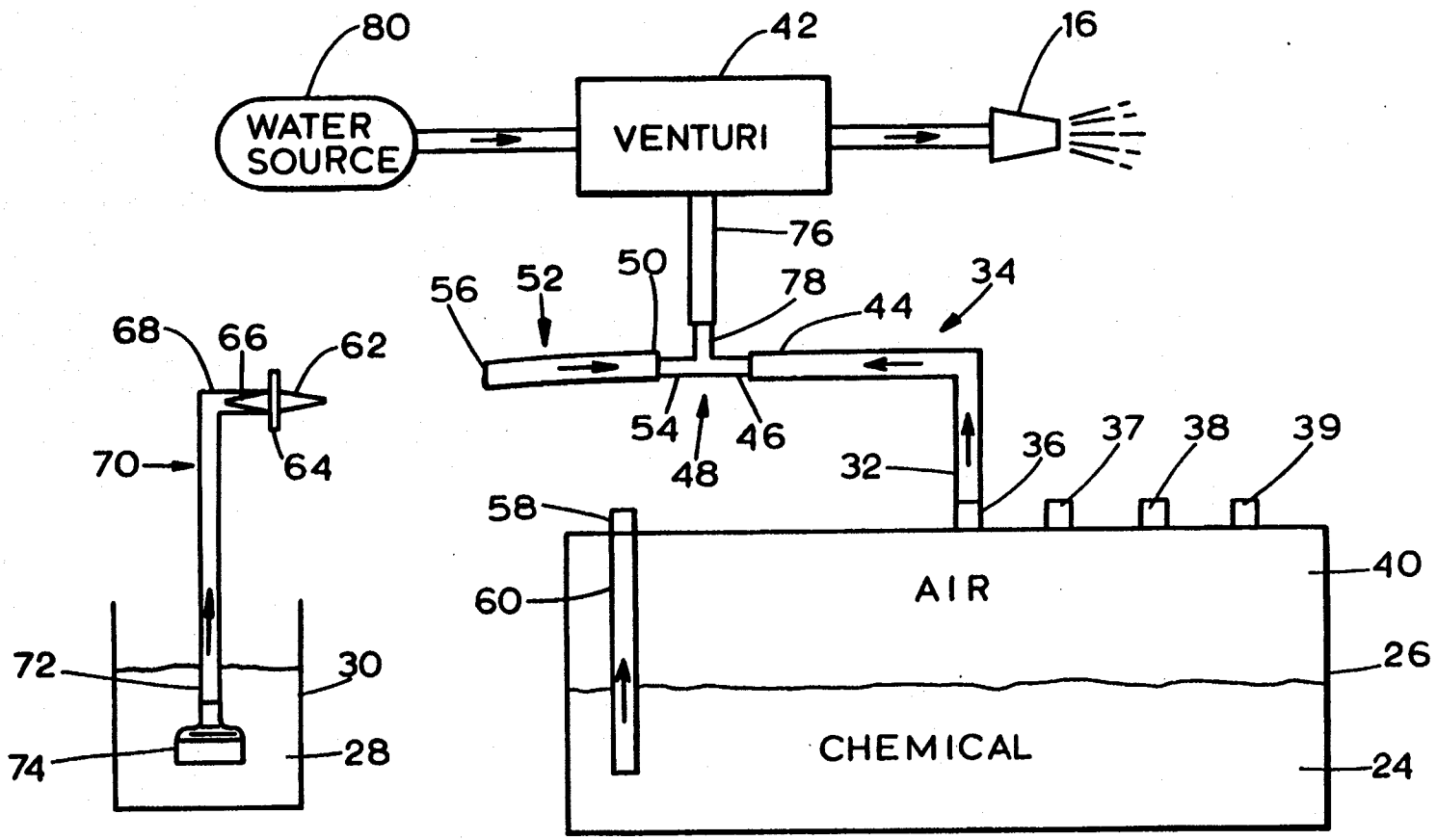
FIG. 3 is a schematic diagram illustrating fluid flow within the pressure washer of FIGS. 1 and 2.

Referring also to FIG. 3, a chemical 24, such as soap or another cleaning agent, may be stored in an internal tank 26 disposed in the tank housing 12. A chemical 28, which may or may not be the same as the chemical 24, may be stored in a container 30 external to the pressure washer 10. One end 32 of a first hose 34 is connected to one of four apertures 36–39 on top of the internal tank 26 contained in the tank housing 12. The apertures 36–39 are in fluid communication with an air space 40 above the chemical 24 in the internal tank 26. Each of the apertures 36–39 has a different diameter and thus, a different fluid flow resistance associated therewith. Therefore, the apertures 36–39 permit different amounts of air flow when connected to a suction source, such as a venturi 42.

An opposite end 44 of the first hose 34 is connected to a first end 46 of a three-way connector 48 contained in the handle 14 of the tank housing 12. One end 50 of a second hose 52 is also connected to a second end 54 of the three-way connector 48. An opposite end 56 of the second hose 52 is connectable to either an aperture 58 in fluid communication with the chemical 24 in the internal tank 26 via a tube 60 or to one end 62 of a male-male hose adapter 64 having a second end 66 in fluid communication with a first end 68 of an auxiliary hose 70. The auxiliary hose 70 is detachable from and external of the pressure washer 10.

A second end 72 of the auxiliary hose 70 may be placed in fluid communication with the chemical 28 in the external chemical container 30. A filtering element 74 may also be attached to the second end 72 of the auxiliary hose 70.

A suction hose 76 is attached to a third end 78 of the three-way connector 48. A low pressure is created in the suction hose 76 by the venturi 42 when water from a water source 80 passes through the venturi 42 and out the spray nozzle 16. This low pressure draws chemical and air through the hoses 52 and 34, respectively, into the water stream passing through the venturi 42, and out the spray nozzle 16. Thus, when the end 56 of the second hose 52 is connected to the aperture 58 of the tube 60 in the internal tank 26, the chemical 24 is drawn from the internal tank 26 and combined with the water stream passing through the venturi 42 and out the spray nozzle 16. Alternatively, when the end 56 of the second hose 52 is connected via the male-male hose adapter 64 to the end 68 of the auxiliary hose 70, and the opposite end 72 of the auxiliary hose 70 is inserted in the external container 30, the chemical 28 is drawn from the external container 30 and combined with the water stream passing through the venturi 42 and out the spray nozzle 16. The filtering element 74 connected to the end 72 of the auxiliary hose 70 filters out any particulate matter that may be present in the external container 30.

As should be evident from the foregoing, a user can change between the internal tank 26 and the external container 30 by simply disconnecting the end 56 of the second hose 52 from the aperture 58 at the top of the tank housing 12 and connecting it via the male-male hose adapter 64 to the end 68 of the auxiliary hose 70. The opposite end 72 of the auxiliary hose 70 can then be inserted in the external chemical container 30.

The external container 30 may have a substantially greater capacity than the internal tank 26 so that a long washing period can be undertaken without the need to refill with chemical. When the external container 30 is empty, further washing can alternatively be undertaken by simply withdrawing the auxiliary hose 70 from the external container 30 and placing the auxiliary hose 70 in a full container.

Further, regardless of whether chemical is to be drawn from the internal tank 26 or the external container 30, the user can control the amount of chemical introduced into the water stream by connecting the end 32 of the first hose 34 to one of the four apertures 36–39 of varying diameters on top of the tank housing 12. More air and correspondingly less chemical is introduced into the water stream when the end 32 of the first hose 34 is placed on a larger diameter aperture. It should be noted that the aperture 39 is sufficiently large such that only air, and therefore no chemical, is combined with the water stream. Thus, by connecting the end 32 of the first hose 34 to the largest aperture 39, pure water flows out of the spray nozzle 16.

Figure 4:
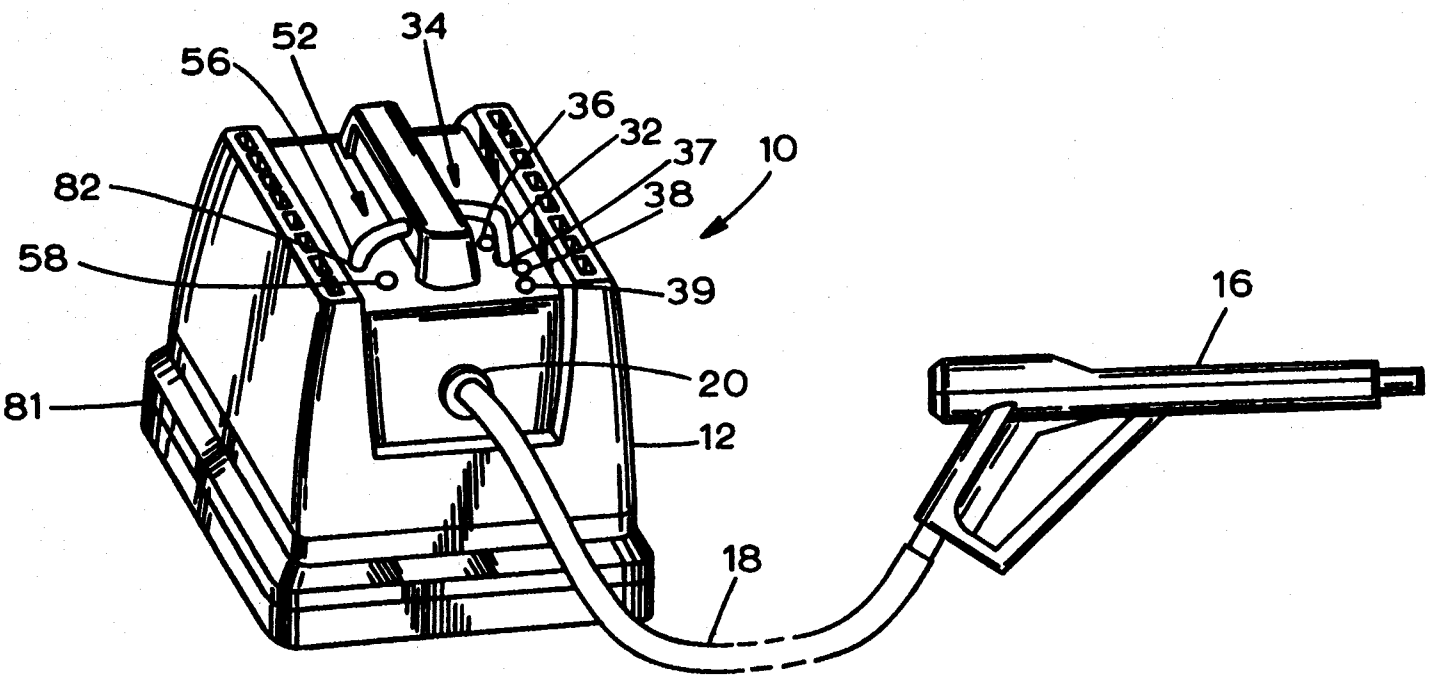
FIG. 4 is a perspective view of an alternative embodiment of the pressure washer of FIG. 1 wherein a chemical is being drawn from a second tank attached to the bottom of the pressure washer.

Referring also to FIG. 4, an alternative embodiment of the pressure washer 10 is shown which allows the user to draw chemical from the internal tank 26, the external container 30 or a second tank 81. The second tank 81 may be attached to the bottom of the tank housing 12 such that the aperture 82 on top of the tank housing 12 is in fluid communication with the second tank 81. The second tank 81 has a larger capacity than the internal tank 26.

When the second tank 81 is attached to the bottom of the tank housing 12, chemical can be drawn from the second tank 81 by connecting the end 56 of the second hose 52 to an aperture 82 on top of the tank housing 12. Chemical is drawn from the second tank 81, through the second hose 52 and combined with the water stream passing through the venturi 42 and out the spray nozzle 16.

In this embodiment, the amount of chemical introduced into the water stream is still controlled by connecting the end 32 of the first hose 34 to one of the apertures 36–39. Further, a user can still change to the internal tank 26 by disconnecting the end 56 of the second hose 52 from the aperture 82 and connecting it to the aperture 58. A user can also change to the external container 30 by connecting the end 56 of the second hose 52 to the auxiliary hose 70 via the male-male hose adapter 64.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which are within the scope of the appended claims, is reserved.

It is claimed:

1. A chemical intake system for a pressure washer having a spray nozzle and an internal tank, comprising:
   - a connector having a first port in fluid communication with the spray nozzle, a second port and a third port connecting the first and second ports with a fluid source for restricting an amount of fluid flow into the spray nozzle through the second port;
   - a first hose connected to the second port for selectively placing the connector in fluid communication with the internal tank; and
   - a second hose selectively connectable to the first hose for placing the connector in fluid communication with a container external to the pressure washer, wherein the second hose is detachable from and external of the pressure washer.

2. The system of claim 1, wherein the first hose has a first end connected to the connector and a second end and the second hose has a first end coupled to a further connector and a second end insertable in the external container.

3. The system of claim 2, wherein the second end of the first hose is connectable to either of the further connector and the internal tank.

4. The system of claim 3, wherein the further connector comprises a male-male hose adapter.

5. The system of claim 3, wherein a filtering element is coupled to the second end of the second hose.

6. The system of claim 5, wherein the second end of the first hose is connectable to an aperture in fluid communication with a second tank which is attached to the pressure washer.

7. The system of claim 1, further including a third hose for interconnecting the third port with one of a plurality of apertures in fluid communication with a portion of the internal tank above a liquid residing therein.

8. The system of claim 7, wherein the apertures have different diameters.

9. A chemical intake system for a pressure washer having a spray nozzle and an internal tank, comprising:

a connector having a first port in fluid communication with the spray nozzle, a second port and a third port connecting the first and second ports with a fluid source for restricting an amount of fluid flow into the spray nozzle through the second port; and means for selectively placing the connector in fluid communication with one of the internal tank, a container external to the pressure washer and a second tank attachable to the pressure washer.

10. The system of claim 9, wherein the second tank is attached to the bottom of the pressure washer.

11. The system of claim 9, wherein the placing means comprises a hose having an end attached to the connector.

12. The system of claim 9, wherein the placing means comprises first and second hoses wherein the first hose is connectable between the connector and either of the internal tank and the second tank and the second hose is connectable between the first hose and the external container.

13. The system of claim 12, wherein the second hose is detachable from and external of the pressure washer.

14. The system of claim 9, wherein the placing means comprises a first hose having a first end connected to the connector and a second end, a second hose having a first end and a second end in fluid communication with the external container and a further connector coupled to the first end of the second hose wherein the second end of the first hose is connectable to one of the further connector, the internal tank and the second tank.

15. The system of claim 14, wherein the second hose is detachable from and external of the pressure washer.

16. The system of claim 14, wherein the further connector comprises a male-male hose adapter.

17. The system of claim 14, wherein a filtering element is coupled to the second end of the second hose.

18. The system of claim 9, further including a third hose for interconnecting the third port with one of a plurality of apertures in fluid communication with a portion of the internal tank above a liquid residing therein.

19. The system of claim 18, wherein the apertures have different diameters.

* * * * *